United States Patent [19]

Anderson et al.

[11] 4,168,195

[45] Sep. 18, 1979

[54] METHOD OF AUTOGENOUSLY BONDING A NONWOVEN POLYAMIDE WEB

[75] Inventors: Richard M. Anderson, Raleigh; Alton L. Caviness, Durham; Virginia C. Menikheim, Chapel Hill; Bernard Silverman, Raleigh, all of N.C.

[73] Assignee: Monsanto Company, St. Louis, Mo.

[21] Appl. No.: 829,741

[22] Filed: Sep. 1, 1977

Related U.S. Application Data

[63] Continuation of Ser. No. 677,189, Apr. 15, 1976, abandoned.

[51] Int. Cl.[2] ..... B29H 9/04; C09J 5/00

[52] U.S. Cl. ..... 156/181; 8/115.5; 8/130.1; 156/305; 156/306; 156/167; 252/372; 428/288; 428/365; 428/289; 428/374; 428/296; 428/395

[58] Field of Search ..... 156/306, 167, 307, 305, 156/308, 324, 181, 83, 555, 316, 497; 427/248 A, 248 E, 354, 381; 428/288, 373, 289, 374, 296, 395, 365; 264/83, 126, 103, 136, 123; 8/115.5, 130.1; 252/372

[56] References Cited

U.S. PATENT DOCUMENTS

| | | | |
|---|---|---|---|
| 3,236,587 | 2/1966 | Genereux | 156/305 |
| 3,516,900 | 6/1970 | Mallonee et al. | 156/306 |
| 3,647,591 | 3/1972 | Morris | 156/220 |
| 3,773,089 | 11/1973 | Chudgar | 156/308 |
| 3,824,146 | 7/1974 | Ellis | 156/167 |
| 3,853,659 | 12/1974 | Rhodes | 156/181 |

*Primary Examiner*—John T. Goolkasian
*Assistant Examiner*—J. J. Gallagher
*Attorney, Agent, or Firm*—Thomas N. Wallin; Donald J. Fitzpatrick; Robert L. Broad, Jr.

[57] ABSTRACT

The method of autogenously bonding a nonwoven web made from polyamide filaments wherein the filaments contain 0.1 to 20 weight percent of an activating agent and sufficient moisture that the molar ratio of water to activating agent in the filaments is above the bonding limit, wherein the web is heated sufficiently to drive off enough water to reduce the molar ratio of water to agent to a value below the bonding limit and pressed to autogenously bond the filaments in the web. After pressing, the activating agent is desorbed from the web.

8 Claims, 3 Drawing Figures

METHOD OF AUTOGENOUSLY BONDING A NONWOVEN POLYAMIDE WEB

This is a continuation, of application Ser. No. 677,189, filed Apr. 15, 1976, (now abandoned).

BACKGROUND OF THE INVENTION a. Field of the Invention

This invention relates to methods for bonding moisture-containing nonwoven webs made from polyamide filaments.

b. Description of the Prior Art

Various methods of bonding nonwoven webs are known. For example, U.S. Pat. No. 3,647,591 discloses a process for bonding a web made up of a blend on nylon fibers and fibers of another kind which are not affected by a strong acid such as hydrochloric acid. The acid is applied to the web from an aqueous solution by spraying or dipping, with the fabric then being hot calendered to bond the nylon filaments in the web together. Under these conditions, the acid dissolves the nylon filaments so that these filaments more or less serve as an adhesive which bonds the entire web together, the other filaments in the web providing strength.

U.S. Pat. No. 3,647,244 discloses a process for bonding a web made from polyamide filaments wherein the web is passed through a preconditioning zone such that the web picks up from 3 to 6 weight percent of water, with the web then being passed through a second zone where the web absorbs a hydrogen halide gas and additional moisture. The purpose of the preconditioning step is to allow the web to pick up the gas at a higher rate. The web is then pressed and self-bonded by washing it in water at room temperature to remove the absorbed gas.

It is known to autogenously bond a web made from polyamide filaments by applying a mixture of an activating agent and water in vapor form to the web and then passing the web between rolls at room temperature. One disadvantage of this process is that ambient humidity has an effect on the amount of bonding achieved when the web is passed between the rolls. It is well known that nylon filaments readily absorb moisture. Under conditions of high ambient relative humidity the web will contain more moisture when it passes between the rolls than at conditions of low ambient relative humidity. The result is bonding which is not uniformly consistent.

SUMMARY OF THE INVENTION

The method of bonding a nonwoven web made from polyamide filaments wherein the filaments contain 0.1 to 20, preferably 0.5 to 6.0 weight percent, of an activating agent and sufficient moisture that the molar ratio of water to agent in the filaments is above the bonding limit, wherein the web is heated sufficiently to drive off enough moisture to reduce the molar ratio of water to agent to a value below the bonding limit while the web is being pressed. Following pressing, the bonded web is washed to remove the activating agent and is then dried.

DETAILED DESCRIPTION OF THE INVENTION

Figure 1:
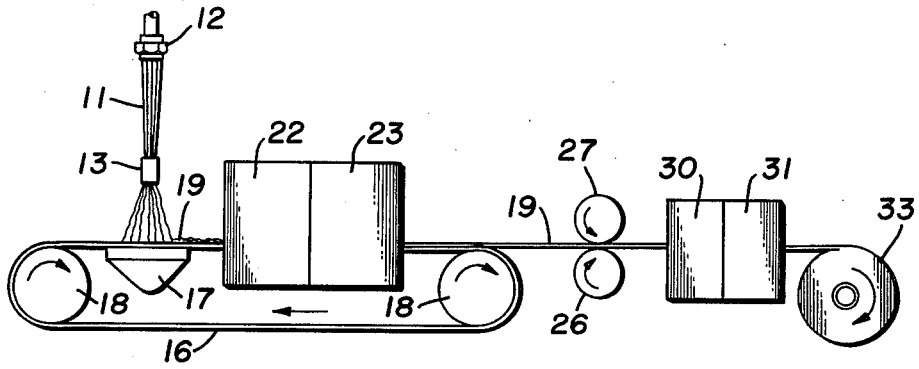
FIG. 1 is a schematic side view showing apparatus useful for carrying out the process of the present invention.

Referring now in detail to the drawing, there is shown in FIG. 1 an apparatus suitable for carrying out the process of the present invention. Polyamide filaments 11 formed by a spinnerette 12 are attenuated by an air nozzle or attenuator 13 and blown onto a porous belt 16, a suction box 17 positioned below the belt 16 retaining the filaments 11 on the belt 16. The filaments are collected on the belt 16 in the form of a nonwoven web 19. This structure and operation is conventional.

The belt 16 is mounted on and moved by rolls 18 to carry the web or fabric 19 formed by the filaments through a chamber 22 where the web, in an unbonded condition, is exposed to an atmosphere containing an activating agent and, optionally, water in gaseous form. The chamber 23 may be constructed in the manner illustrated in U.S. Pat. No. 3,676,244. However, the structure of the chamber 22 is not critical and chambers other than those used in U.S. Pat. No. 3,676,244 may readily be used.

In the chamber 22 the web 19 is gassed by exposure to an atmosphere made up of a mixture of water vapor and an activating agent such as hydrogen chloride in gaseous form. It is not necessary that water vapor be used in the chamber 22 but it is preferred, for the reasons that water vapor enhances the sorption of the activating agent by the web. In this chamber the surfaces of the filaments in the web will sorb hydrogen chloride and water in a molar ratio of about 1 to 1 over a wide range of gas compositions. Generally, the atmosphere in the chamber 22 and the dwell time of the web 19 in the chamber 22 should be such that the web picks up about 0.1 to 20 weight percent of HCl in this chamber. However, it is preferred that the amount of HCl absorbed by the web in the chamber 22 be 0.5 to 6 weight percent.

The term "activating agent" used herein refers to any agent which will, in gaseous form, effect an autogenous bonding of the polyamide filaments described in U.S. Pat. No. 3,516,900 to Mallonee et al. Examples of such effective activating agents are the hydrogen halides, boron trifluoride, sulfur dioxide, sulfur trioxide, and a mixture of chlorine and sulfur dioxide. Hydrogen chloride is the preferred activating agent.

The process of the present invention is operative with filaments having polyamide surface portions. The filaments may be monocomponent polyamide or multicomponent filaments where the filament has a polyamide surface portion. Thus, the process is operative with side-by-side bicomponent filaments where one of the components is polyamide and sheath/core filaments where the sheath is polyamide. The bonding of nylon by this process is an example of a general case in which the polymer may be any composition containing a high degree of hydrogen bonding whose hydrogen bonds may be disrupted by the sorption of an activating agent system (e.g., $H_2O+HCl$ in the polyamide example), followed by desorption of the system to reform the hydrogen bonds. After passing through the chamber 22 the web 19 is passed through a zone where the web is heated sufficiently to drive off enough moisture from the web 19 to reduce the molar ratio of water to agent to a value below the bonding limit. This zone is preferably the nip of a pair of rolls 26 and 27, at least one of which is heated. The term "bonding limit" as used herein refers to that molar ratio of water to activating agent, contained in the filament annulus, above which the web is essentially unbondable when pressed at room temperature. When this molar ratio is exceeded the strip tenacity of the web drops dramatically. This rapid decrease in tenacity as molar ratio is increased is represented by the almost vertical part of the curve shown in FIG. 2 and the similar curve shown in FIG. 3.

Figure 2:
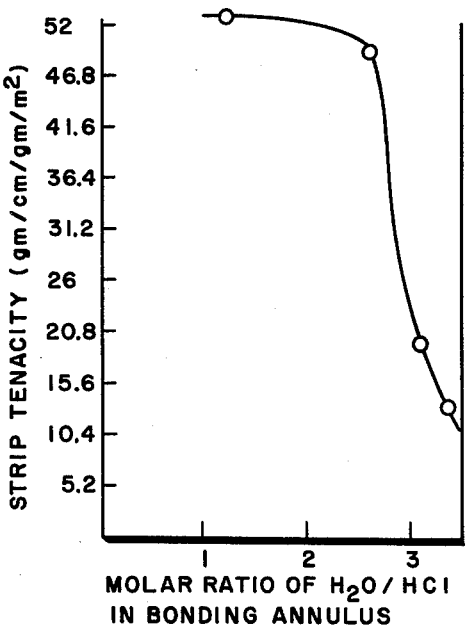
FIG. 2 is a graph of strip tenacity plotted against molar ratio of water to activating agent showing the result of pressing at room temperature a gassed web containing different molar ratios of water to activating agent.

Upon making a number of runs it was found that the almost vertical portion of the curve shown in FIG. 2 occurs between water/HCl molar ratios of about 2 to 3.5. In some cases it was as low as 2 and in other cases as high as 3.5. It is believed that this variation from about 2 to 3.5 is caused by migration of some of the moisture toward the inner portions of the polyamide filaments, thereby lowering the actual molar ratio of water to agent in the outer portions or bonding annuli of the filaments. The reason for the unbondability of the web above these molar ratios is believed to be that, above these molar ratios, enough of the hydrogen bonds in the polyamide structure are disrupted that the surface of the filament passes beyond a tacky stage to a less viscous, non-adhering stage. The terms "filament annulus" and "bonding annulus" refer to the outer portion of each filament in the web, this portion amounting to from less than 1 percent to about 65 percent of the cross sectional area of the filament.

In the chamber 22 the web 19 will readily pick up water and activating agent at a molar ratio of about 1:1. The web 19 is also free to absorb additional moisture from the atmosphere and in humid weather will readily absorb enough moisture from the atmosphere that the molar ratio of water to activating agent exceeds the bonding limit. In this condition the web will be unbondable when pressed at room temperature.

By "unbondable" we mean that the bonding achieved when the web is passed between two steel rolls under a pressure of 17.86 kg per linear cm of roll contact, with the rolls and web being at 21° C., is below acceptable levels. For practical purposes, a web having an acceptable bonding level will have a strip tenacity of not less than 50–70 percent of the strip tenacity of the same web after being passed between rolls heated to about 65° C. and at the same pressure. Normally, the strength of the "unbondable" web when pressed by unheated rolls is about 10 to 40 percent of a like web pressed by hot rolls.

Figure 3:
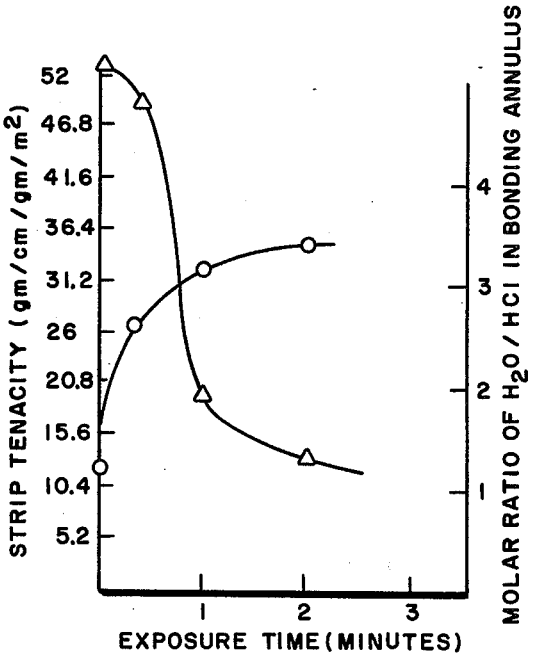
FIG. 3 is a graph of strip tenacity and molar ratio plotted against time of exposure of a polyamide web to a high humidity atmosphere where the web has been pressed at room temperature after exposure.

FIG. 3 shows water HCl molar ratios in the filament annulus and strip tenacities plotted against time of exposure to a humid atmosphere. These curves were obtained by exposing samples to a gaseous mixture of water and HCl to allow the samples to absorb water and HCl at a molar ratio of about 1:1 in the filament annulus and thereafter exposing the samples to an atmosphere of about 76 percent relative humidity for varying periods of time such that the samples after exposure to the humid atmosphere contained various molar ratios of water to HCl in the filament annuli. The samples were then pressed between two steel rolls at a temperature of about 21° C. and the pressure of 17.86 Kg per linear cm of roll and then strip tenacities were determined. From FIG. 3 it is clearly evident that an exposure time of less than 1 minute to the humid atmosphere is sufficient time to increase the molar ratio of water to HCl to a value above the bonding limit.

At least one of the rolls 26 and 27 is heated to a temperature within the range of 60° C. to 230° C. The purpose of these rolls is to compact and bond the web, the heat from the heated roll driving off enough water to lower the molar ratio of water to agent to below the bonding limit. The web then passes through a washing zone 30 where the agent is removed. After the washing step the web is passed through a drying zone 31 and taken up on a roll 33.

COMPARATIVE EXAMPLE I

A nonwoven web made up of polyamide filaments was passed through a chamber where it was exposed to an atmosphere containing 0.5 percent HCl and 0.83 percent moisture by volume. The exposure time of the web was 5 seconds and the web picked up 1.7 weight percent of HCl. Immediately after leaving the gassing chamber the web was passed between a pair of smooth steel rolls at room temperature and under a pressure of 17.86 Kg per linear cm of roll. After pressing, the web had a strip tenacity of 28 gm/cm/gm/m$^2$, a zero span tenacity of 80.6 gm/cm/gm/m$^2$ and a bending length of 3.38 cm.

EXAMPLE II

Example I was repeated with the exception that the fabric was exposed to an atmosphere having a relative humidity of 75 percent to allow the fabric to absorb sufficient additional moisture to increase the molar ratio of water to activating agent to above the bonding limit. The fabric was then pressed in the manner described in Example I and had a strip tenacity of 2.35 gm/cm/gm/m$^2$, a zero span tenacity of 81.4 gm/cm/gm/m$^2$ and a bending length of 2.1 cm. The very low strip tenacity of this example, compared to the strip tenacity of the same fabric in Example I, illustrates that the absorption of sufficient water to raise the molar ratio of water to agent to above the bonding limit effectively prevents bonding of the fabric at room temperature.

EXAMPLE III

To illustrate the effect that additional moisture has on a nonwoven nylon web which has been exposed to an $H_2O$/HCl atmosphere the following runs were made. Nylon webs having a weight of 33.96 grams/m$^2$ were preconditioned to equilibrium at 65 percent RH and were then exposed for 150 seconds to a gas stream containing 0.24 percent HCl and 0.60 percent water, resulting in an absorption of 3.9 weight percent of HCl.

The webs were then exposed for various time intervals to an air stream at 24° C. and a relative humidity of 76 percent to allow the webs to pick up additional moisture prior to pressing. The webs, containing different annular molar ratios of $H_2O$ to HCl were then passed between smooth rolls at 2.7 meters per minute, the roll pressure being 17.86 Kg/cm and the roll temperature being 25° C. The results are shown in Table 1 as Runs A, B, C, and D.

Table 1

| Runs | Exposure time (seconds) | Molar Ratio in filament annulus ($H_2O$/HCl) | Strip Tenacity (gm/cm/gm/m$^2$) |
|---|---|---|---|
| A | 0 | 1.18 | 53.3 |

Table 1-continued

| Runs | Exposure time (seconds) | Molar Ratio in filament annulus ($H_2O/HCl$) | Strip Tenacity ($gm/cm/gm/m^2$) |
|---|---|---|---|
| B | 20 | 2.55 | 49.7 |
| C | 60 | 3.12 | 19.9 |
| D | 120 | 3.37 | 13.6 |
| E | 120 | 3.37 | 47.6 |

It will readily be apparent that increasing the molar ratio of water to agent in the bonding annuli of the filaments increases the resistance of the web to bonding at room temperature. Between molar ratios of 2.55 and 3.12 the strip tenacity dropped from 49.7 to 19.9 $gm/cm/gm/m^2$.

In Run E, which illustrates the process of the present invention, the web was pressed between rolls heated to 150° C. Heated to this temperature, and at a fabric speed of 2.7 meters per minute, the rolls were sufficiently hot to drive off enough water to reduce the molar ratio to below the bonding limit, resulting in a strip tenacity increased to 47.6 $gm/cm/gm/m^2$.

EXAMPLE IV

It would normally be expected that, in any fabric having absorbed enough moisture to increase the molar ratio of water to agent above the bonding limit, that heating of the fabric would drive off agent and water in substantially equal amounts so that the molar ratio would still stay above the bonding limit, resulting in an unbonded web. However, it has been unexpectedly found that, upon heating, the fabric loses substantially more water than agent, so that a molar ratio below the bonding limit can readily be achieved. To illustrate this, several runs were made. Nylon webs having a weight of 33.9 grams per square meter were preconditioned to equilibrium at 65 percent RH and were then exposed to a gas stream containing water and HCl in vapor form to allow the webs to absorb HCl and additional moisture. The webs were then post conditioned by exposure for 3 minutes to a 60 percent RH atmosphere and then were pressed at various speeds between rolls heated to a temperature of 100° C. and at a roll pressure of 17.86 Kg/cm. Table 2 shows the amounts of HCl and water absorbed in the gassing and post conditioned steps and lost during pressing.

Table 1

| Roll Speed | $H_2O$ after Pre-conditioning | After gassing and Post Conditioning | | After Pressing | | Lost in Pressing | | |
|---|---|---|---|---|---|---|---|---|
| m/min. | wt. percent | Wt. % $H_2O$ | Wt. % HCl | Wt. % $H_2O$ | Wt. % HCl | Wt. % $H_2O$ | Wt. % HCl | Molar Ratio $H_2O/HCl$ |
| .305 | 4.44 | 7.32 | 3.42 | 3.22 | 2.49 | 4.10 | 0.93 | 8.9 |
| 1.22 | 3.43 | 5.65 | 3.16 | 2.24 | 2.84 | 3.42 | 0.32 | 21.7 |
| 3.66 | 4.44 | 7.32 | 3.42 | 4.22 | 2.89 | 3.10 | 0.53 | 11.9 |

Table 2 shows that little of the agent is lost from the web during hot pressing, while a large percentage of the water is driven off. The loss of the larger amount of water lowers the molar ratio of water to agent in the web to below the bonding limit, making the web bondable.

What is claimed is:

1. The method of bonding a nonwoven web made from filaments having polyamide surface portions, comprising (a) exposing said filaments to an activating agent and moisture, both in gaseous form, wherein said activating agent is selected from the group consisting of hydrogen halides, boron trifluoride, sulfur dioxide, sulfur trioxide and a mixture of chlorine and sulfur dioxide, so that said filaments sorb about 0.5 to 6 weight percent of said activating agent and sufficient moisture so that the molar ratio of water to agent in the filaments is above the bonding limit, thereby rendering said web unbondable at room temperature;

(b) heating the web sufficiently to drive off enough moisture to reduce said molar ratio to a value below said bonding limit, (c) pressing the web to bond the filaments in the web, and (d) removing the activating agent from the web.

2. The method of claim 1 wherein the activating agent is selected from the group consisting of hydrogen halides, boron trifluoride, sulfur dioxide, sulfur trioxide and a mixture of chlorine and sulfur dioxide.

3. The method of claim 2 wherein the activating agent is hydrogen chloride.

4. The method of claim 2 wherein the web contains 0.5 to 6 weight percent of said agent.

5. The method of claim 4 wherein the web is heated and pressed simultaneously.

6. The method of claim 5 wherein the fabric is heated and pressed in the nip of a pair of rolls.

7. The method of claim 1 wherein the filaments are side-by-side bicomponent filaments with one component being polyamide.

8. The method of claim 1 wherein the filaments are sheath/core filaments with the sheath being polyamide.

* * * * *